US006474514B1

(12) United States Patent
Guillemin et al.

(10) Patent No.: US 6,474,514 B1
(45) Date of Patent: Nov. 5, 2002

(54) POURING CONTAINER HAVING A NON-DRIP LIP

(75) Inventors: Christophe Guillemin, Lourdes (FR); Erik Lebrun, Ibos (FR)

(73) Assignee: SEB S.A., Ecully Cedex (FR)

( * ) Notice: Subject to any disclaimer, the term of this patent is extended or adjusted under 35 U.S.C. 154(b) by 0 days.

(21) Appl. No.: 09/888,427

(22) Filed: Jun. 26, 2001

(30) Foreign Application Priority Data

Jun. 26, 2000 (FR) ..... 00 08187

(51) Int. Cl.[7] ..... A47G 19/14
(52) U.S. Cl. ..... 222/475.1; 222/571
(58) Field of Search ..... 222/571, 572, 222/573, 574, 564, 566, 567, 475.1; D7/315, 317, 318, 319; D23/212; D32/53, 53.1

(56) References Cited

U.S. PATENT DOCUMENTS

| | | | | |
|---|---|---|---|---|
| 2,132,120 A | * | 10/1938 | Pezachowicz et al. | 222/572 |
| 2,315,250 A | * | 3/1943 | Eilers | 222/573 |
| 2,889,080 A | | 6/1959 | Livingstone | |
| D266,690 S | * | 10/1982 | Levin | D23/212 |
| D315,472 S | * | 3/1991 | Balzano | D7/317 |
| 5,549,216 A | * | 8/1996 | Scholl | 222/572 |
| D375,016 S | * | 10/1996 | Ullmann | D7/319 |
| D376,065 S | * | 12/1996 | Ito et al. | D7/319 |
| D419,363 S | * | 1/2000 | Doret et al. | D7/318 |
| D451,750 S | * | 12/2001 | Rissone et al. | D7/319 |

FOREIGN PATENT DOCUMENTS

| | | |
|---|---|---|
| CH | 188 588 | 1/1937 |
| DE | 670 435 | 1/1939 |
| DE | 40 37 673 | 6/1992 |
| DE | 195 10 411 | 10/1996 |
| EP | 0 650 681 | 5/1995 |

* cited by examiner

*Primary Examiner*—Joseph A. Kaufman
(74) *Attorney, Agent, or Firm*—Browdy and Neimark

(57) ABSTRACT

A container for pouring liquids, composed of a vessel having a longitudinal axis and a bottom, and a pouring lip made of a plastic material. The pouring lip has a central pouring part having a pouring end, and lateral parts, and the lip is composed of: an upper wall, a lower wall and a connecting surface that extends between the upper wall and the lower wall; the upper wall is inclined downwardly into the vessel when the longitudinal axis of the vessel has a vertical orientation; and, in the central pouring part, the connecting surface is free of any sharp edge and has an upper segment having a radius of curvature between 0.5 and 2 mm in a plane passing through the longitudinal axis.

25 Claims, 3 Drawing Sheets

POURING CONTAINER HAVING A NON-DRIP LIP

BACKGROUND OF THE INVENTION

The present invention concerns the general technical field of pots or pouring containers, for hot or cold beverages. The invention concerns in particular, but not exclusively, pots for hot beverage machines, such as electric coffee makers.

The document EP 0 650 681 describes a coffee or tea pot having a main pouring lip in which is disposed and additional pouring lip having a lesser thickness than the main pouring lip. The additional lip has lateral interstices with the main lip. This arrangement promotes a return into the pot of any drop of liquid suspended from the end of the additional lip, when the pot is returned from its pouring position to its rest, or upright, position. The additional pouring lip can be removed for cleaning. However, such an operation is tedious and such a structure is more complicated than a simple pouring lip.

BRIEF SUMMARY OF THE INVENTION

An object of the invention is to provide a pot or other container for liquids having a pouring lip that permits a satisfactory pouring of the beverage, while avoiding dripping of liquid from the container, without, for that purpose, requiring special cleaning operations.

Another object of the invention is to provide a container having a pouring lip permitting satisfactory pouring of the beverage, in particular preventing dripping of liquids out of the container, and which is simple and economical to manufacture.

The above and other objects are achieved by a container for pouring liquids, comprising: a vessel having a longitudinal axis and a bottom; and a pouring lip made of a plastic material, wherein the pouring lip has a central pouring part having a pouring end, and lateral parts, and the lip comprises:

an upper wall, a lower wall and a connecting surface that extends between said upper wall and said lower wall; and wherein the upper wall is inclined downwardly into the vessel when the longitudinal axis of the vessel has a vertical orientation; and, in the central pouring part, the connecting surface is free of any sharp edge and has an upper segment having a radius of curvature between 0.5 and 2 mm in a plane passing through the longitudinal axis.

These features permit a satisfactory pouring of the beverage while limiting the retention of drops at the end of the pouring lip when pouring has been halted. A connecting surface that is free of any sharp edge can however include a burr, or seam, created by the separation plane of the mold parts used to mold the container from plastic material.

According to an advantageous arrangement, the connecting surface has a lower edge with a radius of curvature in a radial cross-section of the pouring end that is smaller then the radius of curvature of the upper edge in a radial cross-section of the pouring end. Such arrangement permits halting of the liquid stream to be facilitated and obtaining a return of the beverage into the pouring lip, the height to be crossed by a drop of the liquid thus being limited.

According to another advantageous arrangement, the upper wall has a highly polished, and preferably a mirror-finish, surface. Such an arrangement facilitates flow of the beverage and limits the addition of liquid to a drop that is suspended during return of the container to its upright position.

According to a further advantageous arrangement, the upper segment has a highly polished, and preferably a mirror-finish, surface. Such an arrangement also limits the addition of liquid to a drop that is suspended during return of the container to its upright position.

According to a further advantageous arrangement, the lower edge has a greater roughness than the upper edge. This arrangement opposes flow of the liquid along the lower edge.

According to another advantageous arrangement, the lower wall has a roughness that is greater than that of the upper wall. This arrangement limits the volume of suspended drops.

According to one form of construction, a central edge is disposed between the upper edge and the lower edge.

Advantageously then, the central edge has a roughness that is greater than that of the upper edge.

The central edge can be vertical or inclined and/or have a small lateral projection with respect to the upper edge, due for example to a mold separation plane.

According to another advantageous arrangement, the upper edge has a peak, crest, or apex inscribed in a plane. Such an arrangement simplifies fabrication of the pouring lip.

According to another advantageous arrangement, the inclination of the upper wall is between 25° and 45° with respect to the bottom.

According to another advantageous arrangement, the upper wall has an inclination of 10° with respect to the lower wall. This arrangement permits the thickness of the pouring lip to be reduced.

Advantageously, the thickness of the pouring end is less then 1.2 mm. With this arrangement, retention of a large quantity of liquid under the pouring lip is avoided, as is dripping of suspended drops by coalescence.

According to another advantageous arrangement, the radial length of the lower wall is greater then 4 mm along the axis of the pouring lip. This arrangement permits collection of a drop under the pouring lip while limiting the risk of formation of a liquid flow path along the wall of the container.

According to another advantageous arrangement, the lower wall is extended by an outer projection toward the base of the pouring lip. Such an arrangement permits even more effective retention of a drop that forms under a pouring lip.

Advantageously, the outer projection is substantially vertical. Such an arrangement is easy to fabricate while permitting an effective retention of liquid drops.

According to a preferred embodiment, the height of the outer projection is greater than 1 mm. Such an arrangement prevents, in effect, progression of the drop along the base of the pouring lip.

Advantageously, the outer projection has two lateral parts that are raised in their upper zone with respect to the upper zone of a central part of the outer projection. Such an arrangement improves retention of a suspended drop, which is maintained by surface tension forces of the liquid.

Advantageously also the central part of the outer projection protrudes with respect to the lateral parts of the outer projection. Such an arrangement permits a further improvement in the retention of a suspended drop. For a drop of liquid having a given volume, the drop is better attached to, or flattened against, the walls.

According to one embodiment, the pouring lip is made of polypropylene. Such a material has good molding properties, while being economical.

BRIEF DESCRIPTION OF THE DRAWING

The accompanying drawings provide a non-limiting example of a pouring lip according to the invention.

DETAILED DESCRIPTION OF THE INVENTION

Figure 1:
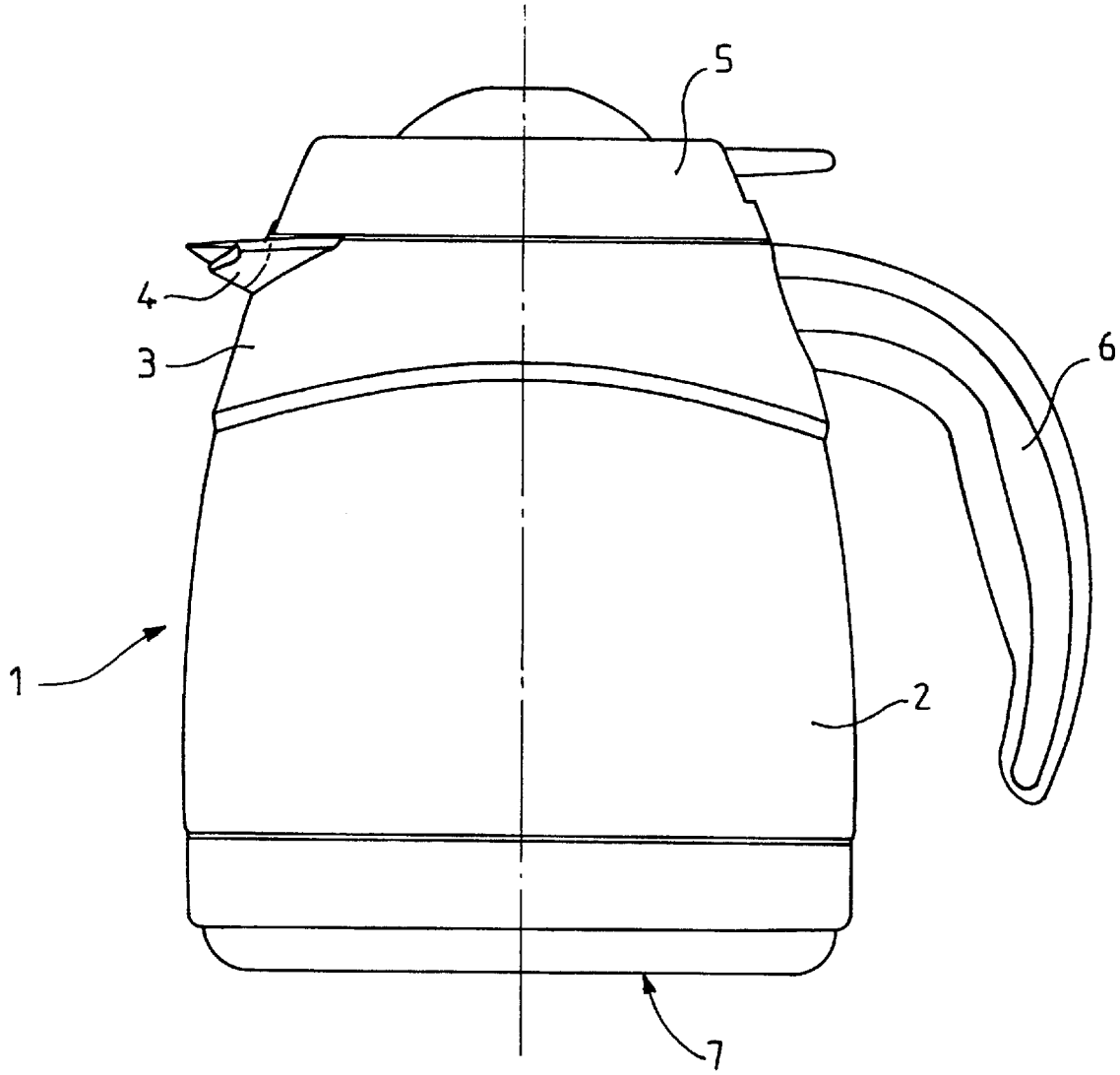
FIG. 1 is a side elevational view of a container for pouring beverages, such as a coffee pot, provided with a pouring lip according to the invention.

The pouring container 1 shown in FIG. 1 is composed of a vessel, or receptacle, 2, which may be a double walled thermal insulating vessel made of, for example, stainless steel, having a vertical longitudinal axis, shown in chain lines in FIG. 1. Receptacle 2 has a bottom 7 whose lower surface is in a plane perpendicular to the above-mentioned vertical longitudinal axis and is provide at its upper end with a pouring lip 4 that may form a unit with an annular part 3 secured to the upper end of receptacle 2. A lid 5 covers part 3 while leaving a passage for the flow of a liquid, such as a beverage, from the interior of vessel 2 to lip 4. If desired, a closing mechanism may be provided. A handle 6 extends laterally from part 3. Part 3 may be made of plastic material, for example polypropylene. Container 1 can particularly be utilized as a pot, or carafe, for receiving a beverage produced in an electric coffee maker.

Figure 2:
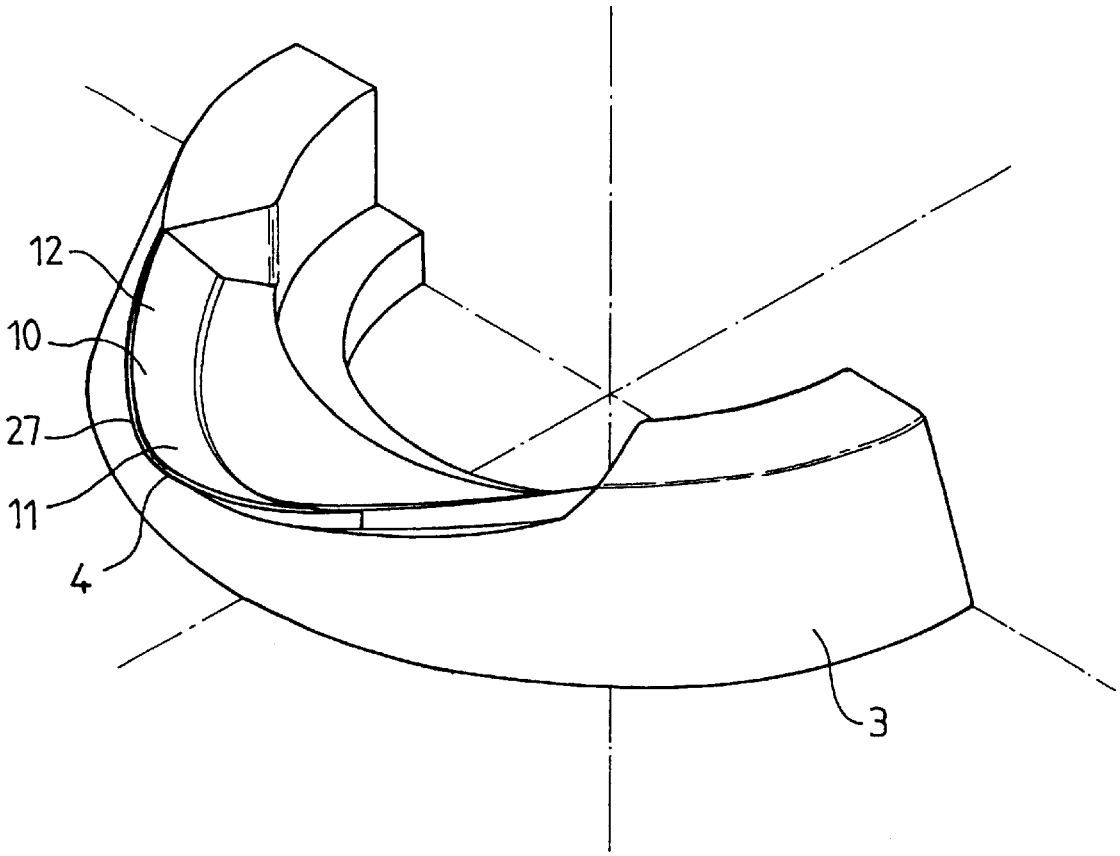
FIG. 2 is a perspective detail view showing the pouring lip of FIG. 1, as viewed from above.
Figure 3:
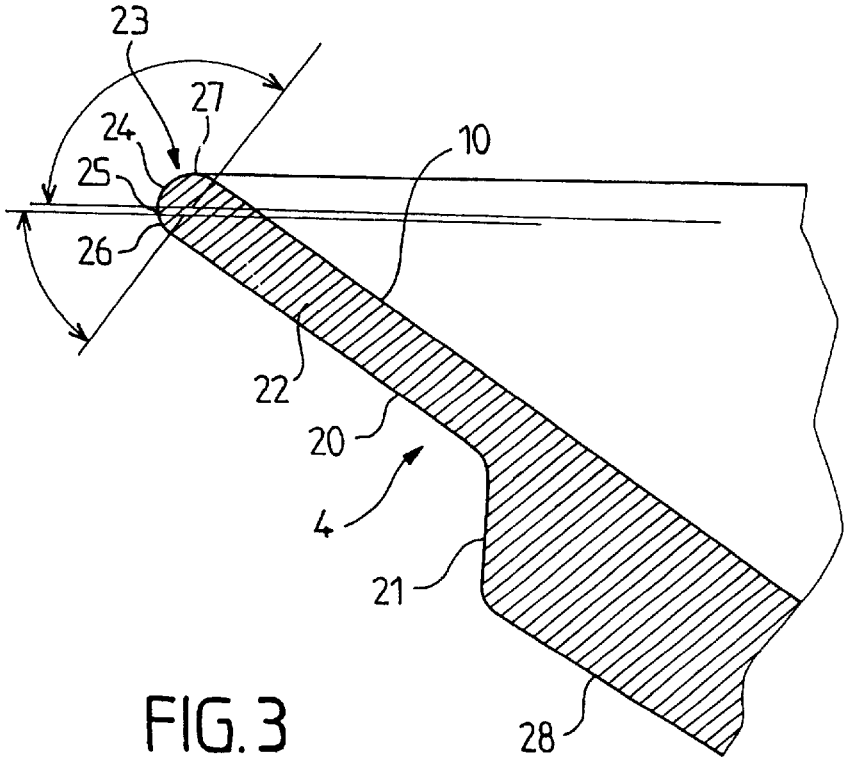
FIG. 3 is cross-sectional detail view of the pouring lip of FIGS. 1 and 2, taken along a vertical plane that passes through the longitudinal, or vertical, axis of the container.

As can be seen more clearly in FIGS. 2 and 3, pouring lip 4 has a curved upper wall 10 that is inclined downwardly toward the interior of the container and provides a linear path in the direction in which it is inclined. As illustrated particularly in FIG. 3, the angle of inclination of wall 10 can have a value of 35° to the horizontal, i.e., to the plane of bottom 7 of container 1. Upper wall 10 has a central pouring part 11 having a curvature that is more pronounced than the curvature of lateral parts 12 of wall 10. This arrangement permits the width of the liquid stream poured from the container to be limited.

Pouring lip 4 also has a lower wall 20. Walls 10 and 20 form a pouring end 22. The lower part of wall 20 is connected by a substantially vertical exterior projection 21 to a base 28. Projection 21 is constituted by a curved surface that extends parallel to the above-mentioned vertical longitudinal axis.

Upper wall 10 has a highly polished surface, which may have a mirror finish. The surface of upper wall 10 is thus very smooth. Lower wall 20, exterior projection 21 and base 28 have a rougher surface state than upper wall 10. Such a surface state can be obtained by electroerosion. The roughness depth obtained is advantageously between 0.005 and 0.10 mm, and preferably between 0.02 and 0.03 mm.

Upper wall 10 is connected to lower wall 20 by a connecting surface 23 having a curved upper segment 24 extended by a substantially vertical lateral segment 25 and then by a curved lower segment 26. As a result of the inclination of walls 10 and 20 of lip 4, upper segment 24 has a curvature extending over an angle of the order of 120° about a horizontal axis corresponding to the center of curvature of surface 23, and lower segment 26 has a curvature extending over an angle of 55°. Upper segment 25 has a peak 27 in the central pouring part 11.

As shown in FIG. 2, peak 27 equally extends to lateral parts 12. Peak 27 lies in a substantially horizontal plane. However, pouring end 22 is slightly lower than the lateral parts, the longitudinal inclination being less than 30 relative to a plane perpendicular to the longitudinal axis of vessel 2. Specifically, this longitudinal inclination is in the plane of FIG. 5, where peak 27 slopes downwardly at the angle of less than 3° from the left to the right.

Figure 4:
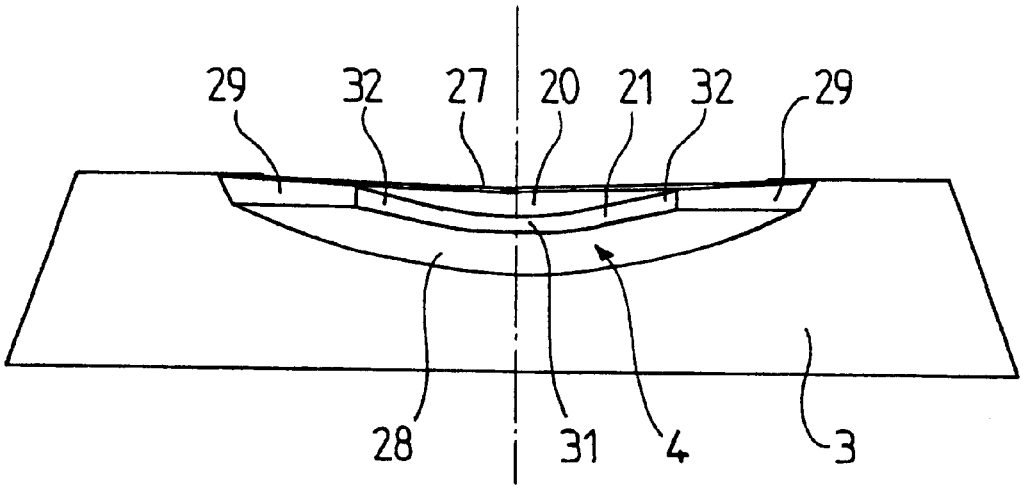
FIG. 4 is a front elevational view of the pouring lip of the embodiment of FIGS. 1–3.

Correspondingly, with respect to the plane of FIG. 4, the center of peak 27 is slightly lower than the edges where peak 27 joins substantially vertical walls 29.

Pouring lip 4 does not have any sharp edge between upper wall 10 and connecting surface 23 or between connecting surface 23 and lower wall 20. Lip 4 also does not have any sharp edge between upper segment 24 of connecting surface 23 and lateral segment 25, or between lateral segment 25 and lower segment 26 of connecting surface 23. The smooth surface state of upper wall 10 extends to, and includes, upper segment 24. The rough surface state of lower wall 20 extends to and includes lateral segment 25, as well as lower segment 26. A seam formed by a mold parting line can thus be located between upper segment 24 and lateral segment 25.

The length of lower wall 20 between exterior projection 21 and lower segment 26, in the plane of FIG. 3, is of the order of 5 mm, and the vertical height of exterior projection 21 is of the order of 1.1 mm.

The radius of curvature of lower segment 26 is smaller than the radius of curvature of upper segment 24. In the example shown in FIG. 3, the radius of curvature of upper segment 24 is 0.5 mm and the radius of curvature of lower segment 26 is 0.3 mm. The height of lateral segment 25 is less than the radius of curvature of lower segment 26. In the example illustrated in FIG. 3, the height of lateral segment 25 is 0.1 mm.

The thickness of pouring end 22 is smaller than the diameter of a drop of liquid suspended at the pouring end under lower wall 20 when the wall is substantially horizontal. This arrangement permits the quantity of liquid forming the drop to be limited. In the example shown in FIG. 3, the thickness of pouring end 22 of lip 4 is 1 mm. A greater thickness can be envisioned, without exceeding 1.5 mm for a pouring lip made of polypropylene. Polypropylene has a substantially greater surface energy than plastic such a PTFE, ABS, or polyethylene. The pouring end should preferably have a thickness less than the diameter of a suspended drop. Since the diameter of a drop that will remain suspended is larger in the case of polypropylene than for other materials mentioned above, the thickness of the pouring end can thus be greater, and will therefore be less fragile, than if other materials are used.

Figure 5:
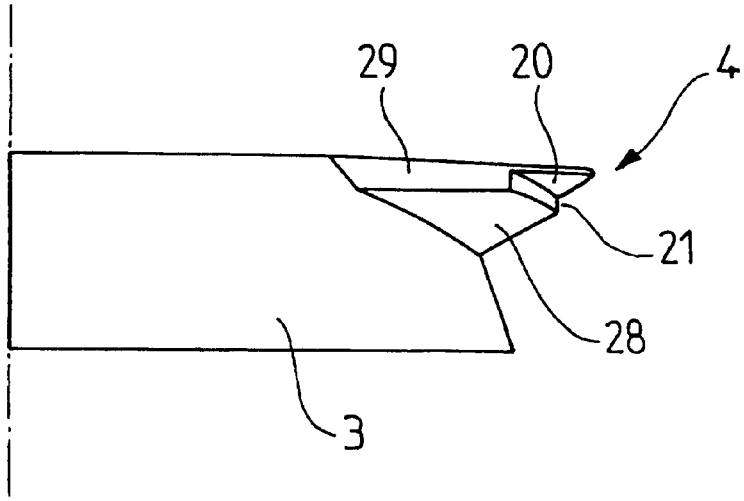
FIG. 5 is side elevational view of the pouring lip shown in FIGS. 1–4.

As shown in FIGS. 4 and 5, base 28 of lip 4 is connected in a central part to the exterior projection 21 and in the lateral parts to substantially vertical walls 29. As is better seen in FIG. 4, exterior projection 21 has an elongated form in a substantially horizontal direction. However, exterior projection 21 has ends 32 that are elevated relative to a central part 31. The angle with respect to the horizontal of each portion of the line connecting exterior projection 21 to lower wall 20 is preferably between 10° and 20° and is for example 15°, as shown in FIG. 4.

The functioning of the pouring lip according to the invention will be described below.

When the user tilts container 1 in order to pour a beverage, the beverage flows over pouring lip 4. The smooth character of upper wall 10 facilitates flow of the liquid. Depending on the speed and flow rate, the beverage can flow in part along lower wall 20, due the attraction of the liquid to the surface at the end of lip 4. The axial length, i.e. the length along the axis of flow of the liquid, of lower wall 20 serves to prevent flow of the liquid along base 28 of the lip. However, when the liquid is being poured relative rapidly, i.e. the liquid is caused to flow without significant interruptions due to a high speed and flow rate, the sufficiently small radius of curvature of upper segment 24 permits the liquid to escape the attraction of the wall of the lip. The smooth character of upper segment 24 facilitates flow of the liquid away from lip 4.

The length of lower wall 20 in the flow direction helps to prevent the liquid from flowing along the lateral wall of the receptacle.

In addition, when the liquid is being poured at a sufficiently high rate, i.e. when the liquid flows without significant interruption, lip 4 according to the invention assures that the flow of liquid will not be interrupted abruptly when the pouring lip is raised, due to the absence of any sharp edge along connecting surface 23. As a result, the quantity of liquid retained under pouring lip 4 is a minimum.

When pouring is to be stopped, container 1 may be tilted backward until the central part 11 of upper wall 10 has arrived at a vertical orientation. At this time, a drop of liquid can remain suspended on upper wall 10 while being supported along peak 27 of upper segment 24. Under these conditions, return of the container to its upright position serves to prevent dripping from the lip.

However, a drop can also remain suspended at pouring end 22 after the flow of the liquid has halted. The suspended drop then comes to be supported at the same time on upper segment 24 and lower segment 26, as well as on lateral segment 25, if that segment is provided. Under these conditions, the drop slides along lower wall 20 when the user lifts lip 4. The roughness of lower wall 20 brakes the movement of the drop.

Exterior projection 21 allows a drop suspended from lower wall 20 to be captured, this drop having a tendency to slide under that wall when container 1 is returned to the rest position shown in FIGS. 1 and 3.

Numerous improvements can be provided to this container in the framework of the invention.

Particularly, lateral segment 25 is not essential.

Peak 27 does not necessarily lie in a plane. The height of peak 27 of upper segment 24 can particularly be lower in central pouring part 11, in a manner to form a neck.

Upper segment 24 and/or lower segment 26 can each have a radius of curvature that varies from one part of the segment to another.

This application relates to subject matter disclosed in French application 0008187, filed Jun. 26, 2000, the entirety of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A container for pouring liquids, comprising a vessel having a longitudinal axis, a bottom and a pouring lip made of a plastic material, wherein said pouring lip has a central pouring part having a pouring end, and lateral parts, and said lip comprises:

an upper wall, a lower wall and a connecting surface that extends between said upper wall and said lower wall;

wherein said upper wall is inclined downwardly into said vessel when the longitudinal axis of said vessel has a vertical orientation;

in said central pouring part, said connecting surface is free of any sharp edge and has an upper segment having a radius of curvature between 0.5 and 2 mm in a plane passing through the longitudinal axis; and said connecting surface further has a lower segment with a radius of curvature in the plane passing through the longitudinal axis that is smaller than the radius of curvature of said upper segment.

2. The container of claim 1 wherein said upper wall has a mirror finish.

3. The container of claim 2 wherein said upper segment has a mirror finish.

4. The container of claim 3 wherein said lower segment has a surface roughness that is greater than that of said upper segment.

5. The container of claim 4 wherein said lower wall has a surface roughness that is greater than that of said upper wall.

6. The container of claim 1 wherein said connecting surface has a central segment disposed between said upper segment and said lower segment.

7. The container of claim 6 wherein said central segment has a surface roughness that is greater than that of said upper segment.

8. The container of claim 7 wherein said central segment extends in a direction that is essentially vertical when the longitudinal axis of said vessel has a vertical orientation.

9. The container of claim 8 wherein said upper edge has a peak that is inscribed in a plane.

10. The container of claim 1 wherein said upper wall has an inclination of between 25° and 45° with respect to a plane perpendicular to the longitudinal axis.

11. The container of claim 10 wherein said upper wall is parallel to said lower wall.

12. The container of claim 11, wherein said pouring end has a thickness less than 1.2 mm.

13. The container according claim 12 wherein said pouring lip presents a flow path having a central axis that is transverse to the longitudinal axis and said lower wall has a length, parallel to the central axis, greater that 4 mm.

14. The container of claim 13 wherein said lip further has a base that is spaced from said lower wall in the direction opposite to the direction of flow of liquid along the flow path, and said lower wall is joined to said base by an outer projection.

15. The container of claim 14 wherein said outer projection extends substantially along the line parallel to the longitudinal axis.

16. The container of claim 15 wherein said outer projection has a height greater than 1 mm.

17. The container of claim 16 wherein said outer projection has lateral parts and a central part located between said lateral parts, each of said parts has an upper zone, and said upper zones of said lateral parts are at a higher elevation than said upper zone of said central part when said container is in an upright position.

18. The container of claim 17 wherein said central part of said outer projection is protuberant with respect to said lateral parts of said outer projection.

19. The container of claim 1 wherein said pouring lip is made of polypropylene.

20. A container for pouring liquids, comprising a vessel having a longitudinal axis, a bottom and a pouring lip made of a plastic material, wherein said pouring lip has a central pouring part having a pouring end, and lateral parts, and said lip comprises:

an upper wall, a lower wall and a connecting surface that extends between said upper wall and said lower wall;

wherein said upper wall is inclined downwardly into said vessel when the longitudinal axis of said vessel has a vertical orientation;

in said central pouring part, said connecting surface is free of any sharp edge and has an upper segment having a radius of curvature between 0.5 and 2 mm in a plane passing through the longitudinal axis;

said upper wall has an inclination of between 25° and 45° with respect to a plane perpendicular to the longitudinal axis;

said upper wall is parallel to said lower wall;

said pouring end has a thickness less than 1.2 mm; and said pouring lip presents a flow path having a central axis that is transverse to the longitudinal axis and said lower wall has a length, parallel to the central axis, greater that 4 mm.

21. The container of claim 20 wherein said lip further has a base that is spaced from said lower wall in the direction opposite to the direction of flow of liquid along the flow path, and said lower wall is joined to said base by an outer projection.

22. The container of claim 21 wherein said outer projection extends substantially along the line parallel to the longitudinal axis.

23. The container of claim 22 wherein said outer projection has a height greater than 1 mm.

24. The container of claim 23 wherein said outer projection has lateral parts and a central part located between said lateral parts, each of said parts has an upper zone, and said upper zones of said lateral parts are at a higher elevation than said upper zone of said central part when said container is in an upright position.

25. The container of claim 24 wherein said central part of said outer projection is protuberant with respect to said lateral parts of said outer projection.

* * * * *